US007955239B2

(12) United States Patent
Wojtkiw et al.

(10) Patent No.: US 7,955,239 B2
(45) Date of Patent: Jun. 7, 2011

(54) PORTABLE EXERCISE APPARATUS

(75) Inventors: Jeremy J. Wojtkiw, Calgary (CA); Charles S. Lau, Calgary (CA)

(73) Assignee: Wholesome Trading Limited, Tortola (VG)

( * ) Notice: Subject to any disclaimer, the term of this patent is extended or adjusted under 35 U.S.C. 154(b) by 223 days.

(21) Appl. No.: 12/301,855

(22) PCT Filed: May 22, 2007

(86) PCT No.: PCT/CA2007/000894

§ 371 (c)(1),
(2), (4) Date: Nov. 21, 2008

(87) PCT Pub. No.: WO2007/137399

PCT Pub. Date: Dec. 6, 2007

(65) Prior Publication Data

US 2010/0234191 A1 Sep. 16, 2010

(30) Foreign Application Priority Data

May 26, 2006 (CA) ..... 2548565

(51) Int. Cl.
*A63B 21/04* (2006.01)

(52) U.S. Cl. ..... 482/129

(58) Field of Classification Search ..... 482/129, 482/148, 139, 51, 907, 44–46, 91, 92, 110, 482/114–120, 131, 135, 127, 904; 182/231–234; 188/264

See application file for complete search history.

(56) References Cited

U.S. PATENT DOCUMENTS

| | | | | | |
|---|---|---|---|---|---|
| 518,967 | A | * | 5/1894 | Poole | 482/116 |
| 1,305,979 | A | * | 6/1919 | Cobe | 24/657 |
| 3,023,978 | A | * | 3/1962 | Evelyn et al. | 242/244 |
| 3,640,530 | A | | 2/1972 | Henson et al. | |
| 3,929,331 | A | * | 12/1975 | Beeding | 482/116 |
| 3,977,676 | A | | 8/1976 | Geisselbrecht | |

(Continued)

FOREIGN PATENT DOCUMENTS

| | | |
|---|---|---|
| CA | 1305979 | 8/1992 |

(Continued)

OTHER PUBLICATIONS

International Search Report and Written Opinion dated Aug. 23, 2007, issued in International Application No. PCT/CA2007/000894.

*Primary Examiner* — Lori Baker
(74) *Attorney, Agent, or Firm* — Holme Roberts & Owen LLP

(57) ABSTRACT

An apparatus for treating or training individuals while doing exercises permits a large range of motion while at the same time providing resistance. A hollow spherical housing having a spool and a cord inside is mounted within a support frame which permits the housing to rotate 360 degrees about a central z-axis and further about 120 degrees about the x-axis and the y-axis when the cord contacts the frame. A tension dial permits adjusting the tension applied to the spool to provide resistance as a user pulls the cord from the housing. When the user releases the force on the cord the cord is retracted onto the spool. The base of the support frame has opposing locking lugs which engage keyways in a co-operating socket which can be mounted on a variety of surfaces such as walls, doors and straps for attachment to a wrist or ankle or other body part.

20 Claims, 19 Drawing Sheets

U.S. PATENT DOCUMENTS

| | | | | | |
|---|---|---|---|---|---|
| 3,995,853 | A | * | 12/1976 | Deluty | 482/116 |
| 4,093,210 | A | * | 6/1978 | Terpening | 482/44 |
| 4,174,832 | A | * | 11/1979 | Thompson | 482/120 |
| 4,484,741 | A | * | 11/1984 | Bingisser | 482/114 |
| 4,557,480 | A | | 12/1985 | Dudley | |
| 4,779,866 | A | * | 10/1988 | Marshall et al. | 482/116 |
| 4,854,750 | A | * | 8/1989 | Lavin | 384/500 |
| 4,871,165 | A | * | 10/1989 | Marshall et al. | 482/116 |
| 5,147,264 | A | * | 9/1992 | Braathen | 482/118 |
| 5,215,386 | A | * | 6/1993 | O'Dwyer | 384/537 |
| 5,429,572 | A | * | 7/1995 | Brown et al. | 482/116 |
| 5,486,149 | A | * | 1/1996 | Smith et al. | 482/120 |
| 5,511,740 | A | * | 4/1996 | Loubert et al. | 242/381 |
| 5,709,637 | A | | 1/1998 | Gow et al. | |
| 5,876,310 | A | | 3/1999 | Mackey et al. | |
| 6,149,559 | A | * | 11/2000 | Mackey | 482/124 |
| 6,309,328 | B1 | | 10/2001 | Dudley | |
| 6,551,220 | B1 | | 4/2003 | Schroeder | |
| D493,200 | S | * | 7/2004 | Hsu | D21/662 |
| 6,770,014 | B2 | | 8/2004 | Amore | |
| 6,780,144 | B2 | * | 8/2004 | Stevens | 482/91 |
| 6,821,236 | B2 | * | 11/2004 | Liang | 482/138 |
| 7,087,001 | B1 | * | 8/2006 | Ihli | 482/115 |
| 7,137,936 | B1 | * | 11/2006 | Shaw et al. | 482/127 |
| 7,413,139 | B2 | * | 8/2008 | Benvenuti et al. | 242/421.1 |
| 7,621,856 | B1 | * | 11/2009 | Keith et al. | 482/127 |
| 7,766,757 | B2 | * | 8/2010 | Brooks et al. | 473/215 |
| 2001/0021665 | A1 | * | 9/2001 | Gouji et al. | 463/7 |
| 2002/0086779 | A1 | * | 7/2002 | Wilkinson | 482/118 |
| 2003/0203796 | A1 | | 10/2003 | Yu | |
| 2004/0043873 | A1 | * | 3/2004 | Wilkinson et al. | 482/54 |
| 2004/0204294 | A2 | * | 10/2004 | Wilkinson et al. | 482/54 |
| 2009/0261540 | A1 | * | 10/2009 | Mejia | 280/1.5 |

FOREIGN PATENT DOCUMENTS

| | | |
|---|---|---|
| WO | 98/35725 | 8/1998 |

* cited by examiner

A-A

B-B 71
73
75
50
52
54
58
34
32
36
37
38
39
40
42
43
44
45
46
47
48
70
72
76
78
80
81
82
83
84
86
87
88
89
90
95

PORTABLE EXERCISE APPARATUS

CROSS-REFERENCE TO RELATED APPLICATIONS

The present application is a U.S. National Phase patent application under 35 U.S.C. §371 of International Application No. PCT/CA2007/000894, filed May 22, 2007, which claims priority to Canadian Patent Application No. 2,548,565, filed May 26, 2006, both of which are expressly incorporated herein by reference.

FIELD OF THE INVENTION

Embodiments of the invention relate to portable apparatus to aid in performing physiotherapy exercises for injury rehabilitation as well as training and fitness exercises and more particularly to portable devices which provide resistance during the performance of said exercises.

BACKGROUND OF THE INVENTION

It is known to use apparatus to provide resistance during the performance of one or more movements in order to rehabilitate patient injuries such as those resulting from stroke or other injury, for use with paraplegic patients or to train individuals and to build the necessary muscle tone, muscle endurance and strength to participate in sports, such as distance running, racquet sports, golf and the like.

A number of resistance devices are incorporated into large exercise equipment suitable for use in a clinic or training facility however range of motion may be limited by the structure of the equipment. Further, access to the equipment is limited to pre-booked appointments or availability and the patient or person wishing to use the equipment must repeatedly travel to its location in order to perform the necessary exercises.

In order to increase compliance and to make resistance equipment more readily available, a number of portable resistance devices have been created. Such devices are taught, for example, in U.S. Pat. Nos. 4,147,832 to Thompson, 4,557,480 to Dudley, 4,871,165 to Marshall et al., 5,709,637 to Gow et al., 5,876,310 to Mackey et al., 6,149,559 to Mackey, 6,770,014 to Amore and US published patent application 2002/00866779 to Wilkinson.

Typically, known portable resistance devices may be connectable to a fixed structure such as a door or to the floor or may be connected to a portion of the user's body, during use. In most cases, a tensile member is releasably mounted on a reel and is placed under tension by some form of tensioning means, such that when the user pulls on an end of the tensile member, the tension member is released from the reel along a path from a fixed point on the apparatus and relative to the movement performed by the user.

There is interest in the industry to find additional resistance devices which provide a large range of motion enabling treatment for a wide variety of injuries and training for a wide variety of sports, as well as adjustable tensioning of the tensile member and connection to a variety of surfaces including various body parts and stationary surfaces such as walls and doors to provide the widest use possible in a portable device.

SUMMARY OF THE INVENTION

An apparatus for performing exercises with resistance for treating or training an individual permits a large range of motion as a result of a substantially spherical hollow housing mounted within a support means which allows the housing to rotate 360 degrees about a z-axis and about the x-axis and y-axis until a tensile member releasably and retractably housed within the housing contacts the support means. In one embodiment the housing can rotate about the x-axis and the y-axis about 120 degrees. In another embodiment the apparatus is capable of providing variable resistance.

In a broad aspect of the invention therefore, apparatus for performing exercises with resistance comprises: a tensile member; a reel assembly for repeatedly deploying and retracting the tensile member thereon; a housing for rotatably supporting the reel assembly therein; and support means for rotatably supporting the housing therein, the support means having a z-axis extending therethrough, the housing being supported for rotation substantially 360 degrees about a z-axis, the housing being further rotational about an x-axis and a y-axis, rotation being limited about the x and y-axes by interference contact of the tensile member with the support means.

The support means comprises a ring encircling the housing between an equator of the housing and the tensile member so as to retain the housing in the support means, the ring supporting the housing for rotation therein; a base spaced from the ring on an opposing side of the equator from the tensile member for rotationally supporting the housing between the ring and the base; and two or more arcuate span members for connecting between the base and the ring.

The reel assembly comprises the spool for releasably retaining the tensile member thereon; tensioning means for acting upon the spool for adjusting the tension applied thereon, altering resistance to unwinding the tensile member from the spool; and means for mounting the reel assembly in the hollow housing. Preferably, the tensioning means comprises a tape adjustably acting on the spool; indexing means connected to the band using biasing means; and a gear connected between the tension dial and the indexing means, wherein when the tension dial is rotated the gear engages the indexing means for adjusting the tension of the band acting on the spool for increasing or decreasing friction between the band and the portion of the spool so as to increase or decrease the tension applied thereto. Preferably the tape engages a tubular flange on the spool through a tension ring which has an outer channeled surface for housing the tape and a ratcheted inner surface. Two or more stops moveably mounted in the tubular flange and biased outwardly therefrom engage the ratcheted inner surface to permit co-rotation of the spool and the tension ring in one direction and independent ratcheting rotation of the spool in the other direction.

The reel assembly is preferably mounted to a stationary bracket in the housing. Further, a retraction means comprises biasing means such as a spring mounted inside the spool and connected between the spool and the stationary bracket. As the spool and tension ring are co-rotated to permit deployment of the cord with resistance, the spring is wound tightly. When force is released from the cord, the spring returns to its original shape, causing the spool to move independently in the opposite direction.

Preferably, a tension dial is mounted on the outside of the housing to permit the tape to be moved as the tension dial engages a gear which further engages indexing means connected to the tape.

Preferably two or more opposing locking lugs extend from the base of the support means for engagement with corresponding keyways on a cylindrical socket suitable for mounting on a plurality of surfaces. Thus the apparatus is permitted to be stationary during deployment and retraction of the cord if mounted to a wall or to a door, the socket mounted on a door bracket or a mounting plate or to be stationary or moved in an opposing direction if mounted to a body part, such as a wrist, an ankle, a thigh or the chest such as through a strap to which the socket is mounted.

In an alternate embodiment, an end of the cord can be mounted to a sleeve which is installed on the grip end of a sport apparatus such as a golf club or a racquet handle and the portable exercise apparatus can be strapped to a leading ankle to permit swinging the sport apparatus against a resistance.

BRIEF DESCRIPTION OF THE DRAWINGS

FIGS. 17*a* and 16*b* are schematic elevation views of a user performing a backhand stroke for racquet sports, more particularly, FIG. 17*a* illustrates a beginning of the backhand stroke.

FIG. 17*c* illustrates a beginning of the forehand stroke; and FIG. 17*d* illustrates an end of the forehand stroke;

FIG. 18*a* illustrates a beginning of the supine hip abductor kick; and FIG. 18*b* illustrates an end of the supine hip abductor kick;

FIG. 18*c* illustrates a beginning of the supine hip adductor kick; and FIG. 18*d* illustrates an end of the supine hip adductor kick;

FIG. 18*e* illustrates a beginning of the side lying hip adductor lift; and FIG. 18*f* illustrates an end of the side lying hip adductor lift;

FIG. 19*a* illustrates a beginning of the arm extension wherein a shoulder blade is first retracted; and FIG. 19*b* illustrates an end of the arm extension wherein the shoulder blade is protracted;

FIG. 19*c* illustrates the beginning of the pectoralis stretch; and FIG. 19*d* illustrates the end of the pectoralis stretch wherein the arm is adducted across the chest to contract the pectoralis muscles; FIG. 20*a* illustrates a beginning of the downswing stroke; and FIG. 20*b* illustrates an end of the downswing stroke.

DETAILED DESCRIPTION OF THE PREFERRED EMBODIMENT

Figure 1:
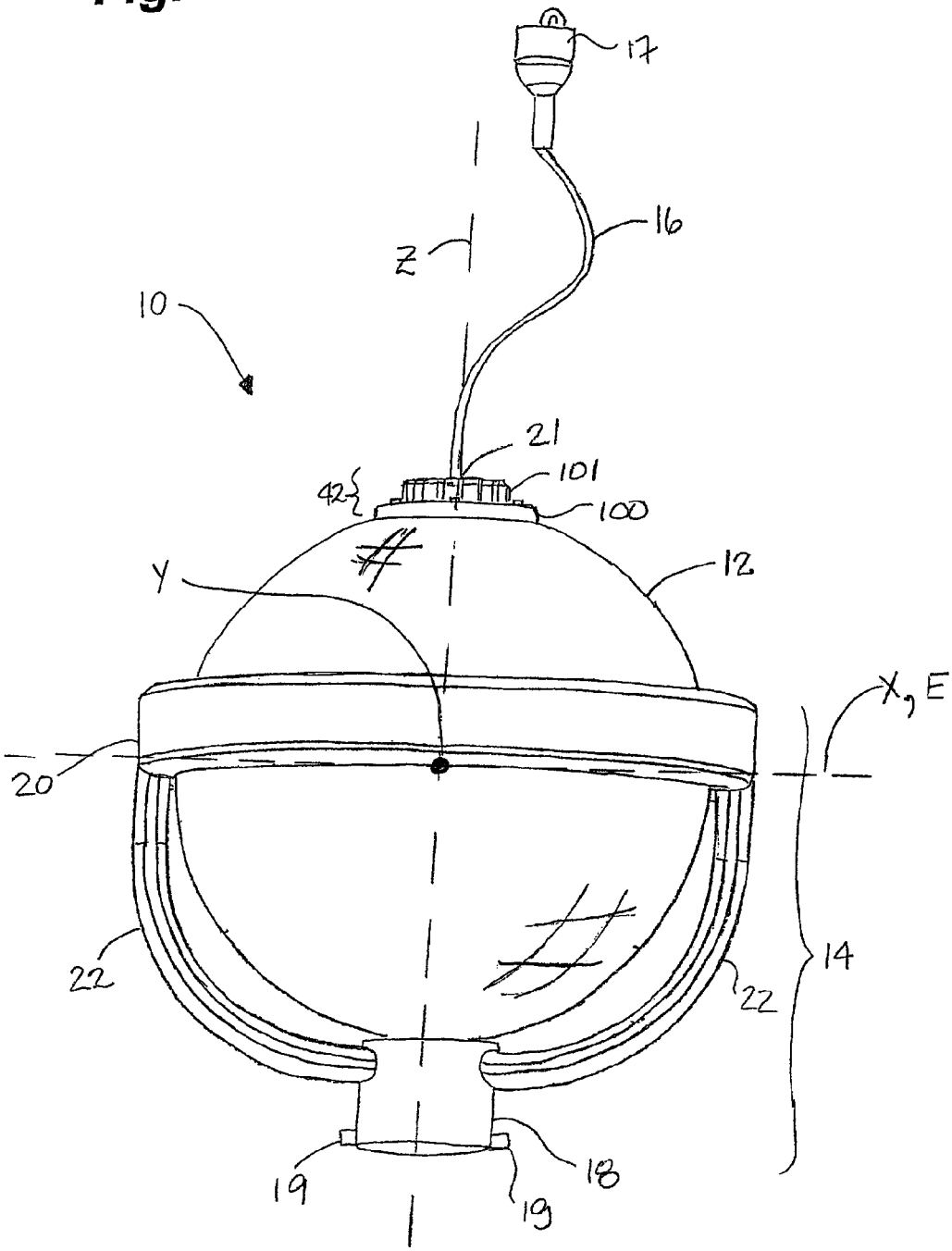
FIG. 1 is a perspective view of the portable exercise apparatus according to an embodiment of the invention.

Having reference to FIG. 1, an exercise apparatus 10 according to an embodiment of the invention, comprises a housing 12 supported in a support means 14 which can be attached to a variety of surfaces such as to a body part or to a wall or door or the like.

A flexible tensile member 16 is housed in the housing 12 and extends thereform through a port 21 in the housing 12. The housing 12 is rotatable in the support means 14 substantially 360 degrees about a z-axis extending through the housing 12 and is rotatable about an x and y-axis, the rotation limited by interference of at least the tensile member 16 contacting the support means 14. As the tensile member 16 is pulled from the housing 12, the housing 12 rotates about any or all of the three axes x, y, z to permit a large range of motion. Preferably, the housing 12 is rotatable about 120 degrees about the x-axis and the y-axis.

For ease of manufacture and insertion of the tensile member 16 and related tension and retraction apparatus into the hollow housing 12, the housing 12 is formed in two parts, an upper housing 12*a* and a lower housing 12*b*, the upper and lower housing 12*a*, 12*b* being press fit or typically threaded for screwing together to form the housing 12 following insertion of the tensile member 16.

In the preferred embodiment, as shown in FIGS. 1-13, the housing 12 is substantially spherical and hollow. The support means 14 has a base 18, a ring 20 spaced from the base 18 slightly above an equator E (also see FIG. 3) of the housing 12 between the equator E and the tensile member 16 for retaining the housing 12 therein and at least two arcuate span members or arms 22 which support the ring 20 spaced from the base 18 while permitting rotation of the housing 12 therein. The ring 20 is supported on a substantially circular member 24 connected to the arms 22. Preferably, bearings 26 are fit in the base 18 and about the ring 20 for ease of rotation of the housing 12 thereon.

As shown in FIGS. 1 and 4-11, the tensile member 16, such as a rope or cord, is retained for repeated deployment and retraction on a reel assembly 30, housed within the substantially spherical hollow housing 12. The reel assembly 30 comprises a spool 32 on which the cord 16 is wound, means for tensioning 40 for applying resistance to the cord 16 when force is applied to the cord 16 to deploy the cord 16 from the housing 12, such as by pulling thereon, and means for retraction 50 for retracting the cord 16 onto the spool 32 when the force is released from the cord 16. Preferably, the reel assembly 30 is mounted within the hollow housing 12 using a stationary bracket 60. Additional structure is provided within the hollow housing 12 to support the stationary bracket 60 and reel assembly 30.

A tension dial 42 is positioned on an external surface 13 of the housing 12 and is connected to the means for tensioning 40 housed therein to permit the user to adjust the resistance applied to the spool 32 so as to create tension when pulling on the cord 16. The tension dial 42 is preferably situated around the port 21 through which the cord 16 extends and bears indicia, such as L, M, and H, indicative of the degree of tension to be applied. The rotation of the housing 12 about the x-axis and the y-axis may also be limited by interference of the tension dial 42 contacting the ring 20.

Figures 6, 7:
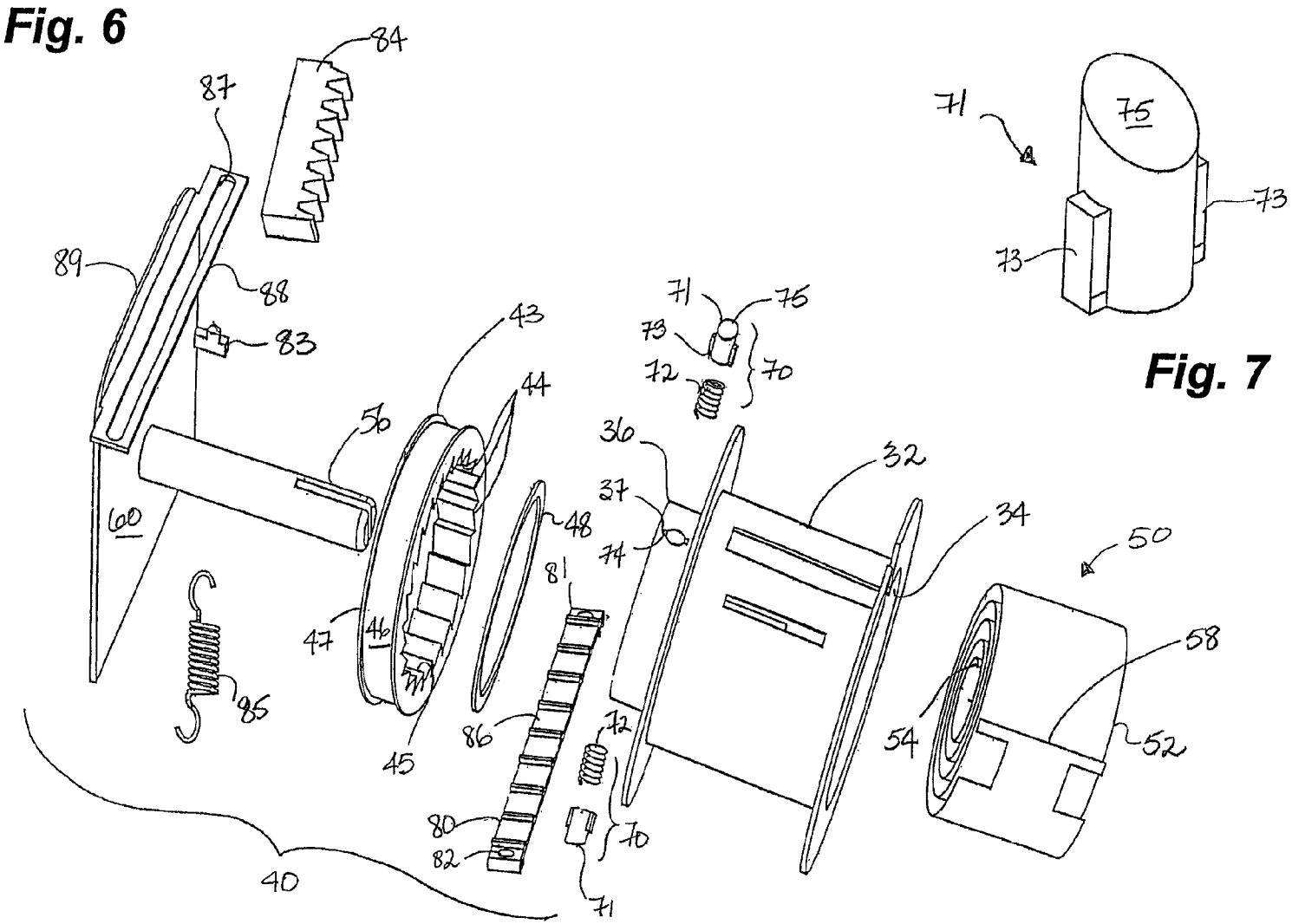
FIG. 6 is an exploded view of the embodiments of the reel assembly and the tensioning means according to FIG. 4.
FIG. 7 is a perspective view of a stop of a clutch means of the tensioning means according to FIG. 6.
Figure 8:
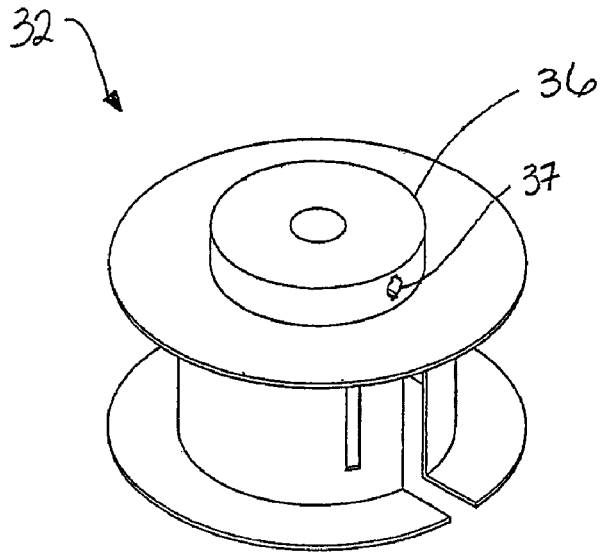
FIG. 8 is a perspective view of a spool of the reel assembly according to FIG. 6.
Figure 9:
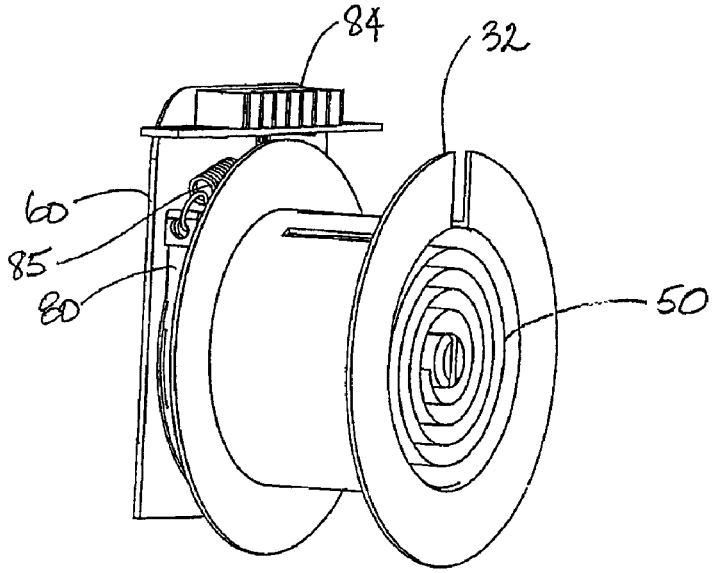
FIG. 9 is a perspective view of the assembled reel assembly and tensioning means of FIG. 6.
Figure 10B:
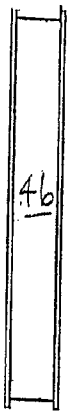
FIG. 10*b* is an end view of the tension ring according to FIG. 10*a;*
Figure 10A:
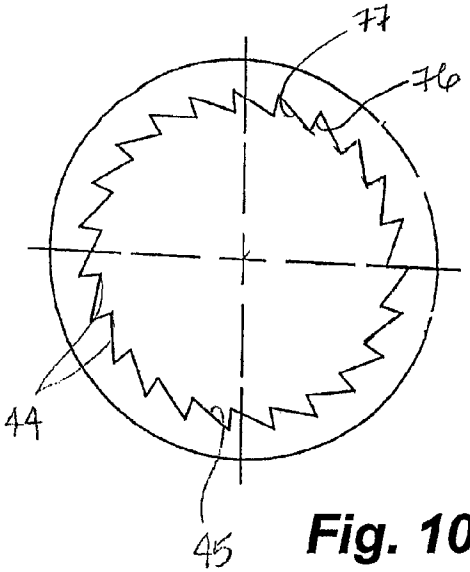
FIG. 10*a* is a side view of a tension ring of the tensioning means according to FIG. 6.
Figure 10C:
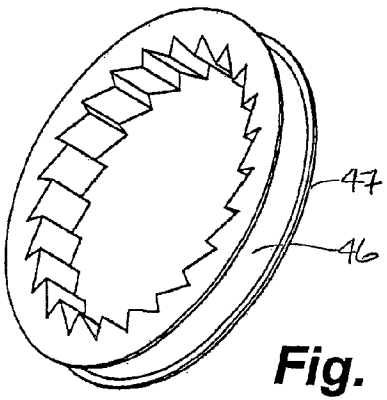
FIG. 10*c* is a perspective view of the tension ring according to FIG. 10*a;*
Figure 11:
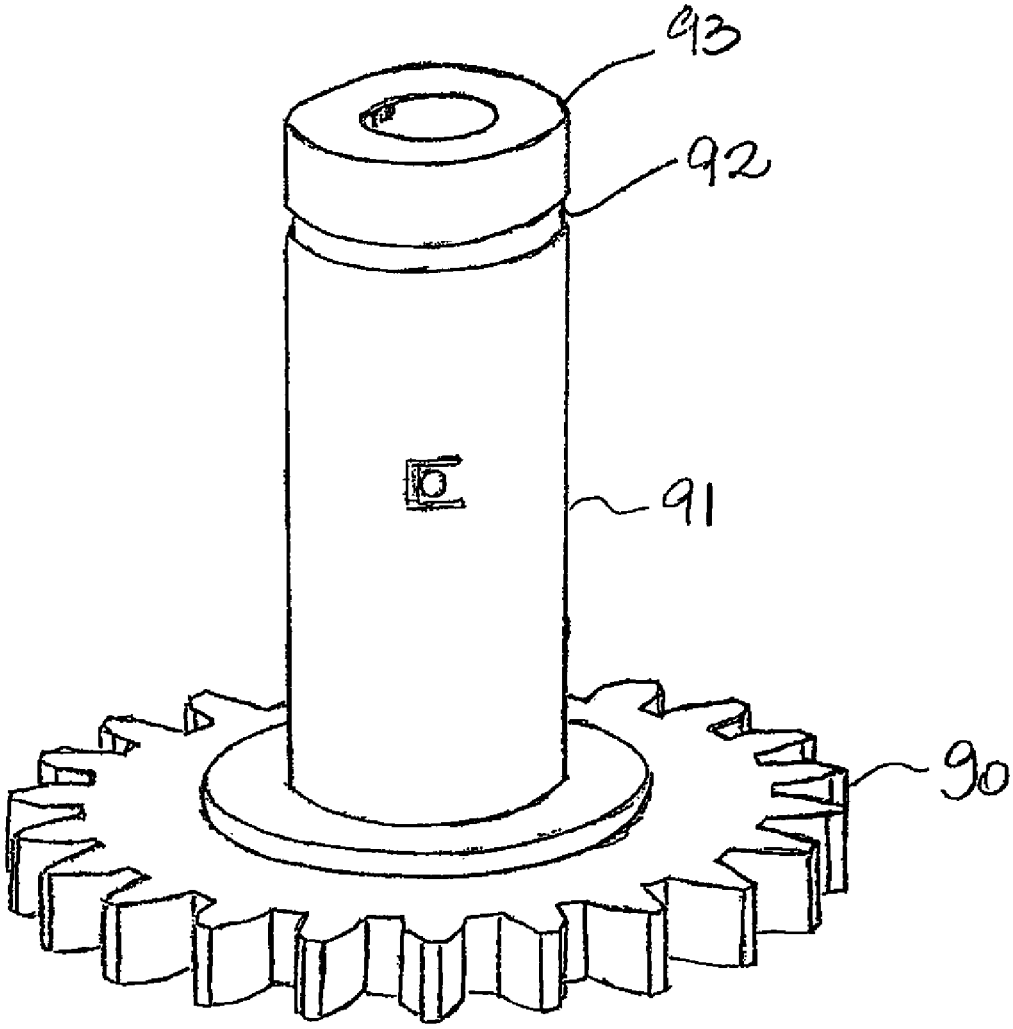
FIG. 11 is a perspective view of a gear wheel and shaft of the tensioning means according to FIG. 6.

Having reference to FIGS. 6 and 9, the spool 32 of the reel assembly 30 is mounted to the stationary bracket 60. Preferably the retraction assembly 50 comprises a means for biasing, such as a coil spring 52, mounted inside a center 34 of the spool 32 and connected at a first end 54 to the housing by a means for connecting comprising a non-rotating support, such as a post 56, the post 56 extending outwardly from the stationary bracket 60, and at a second end 58 to the spool 32. As the spool 32 is caused to rotate to release the cord 16 wound thereon, typically by pulling on an end 17 of the cord 16 as the user moves the end 17 of the cord 16 away from the apparatus 10, the coil spring 52 is caused to wind tightly, storing energy therein. At a point at which the pulling force is released on the cord 16, the coil spring 52 releases the stored energy and returns to its original shape causing the spool 32, attached thereto, to rotate in an opposite direction for retracting the cord 16 and winding it back onto the spool 32. Typically, the rate of the rewinding of the cord 16 is controlled by the user as the user moves the end 17 of the cord 16 toward the apparatus 10 to complete the exercise.

Preferably, the tensioning means 40 comprises a tension ring 43 which is fit over a tubular flange 36 extending from the spool 32. The tension ring 43 is formed having a plurality of teeth 44 about an inner surface 45 and a channel 46 formed about an outer surface 47. The toothed inner surface 45 engages the tubular flange 36 of the spool 32 and the tension ring 43 is caused to co-rotate with the spool 32 by clutch means 70, releasably engaging the teeth 44. Preferably, a washer 48 is positioned between the spool 32 and the tension ring 43 to prevent wear therebetween.

As shown in FIGS. 6 and 7, the clutch means 70 comprise at least one pawl or stop 71 mounted in a hole 37 in the tubular flange 36 and biased outwardly therefrom into engagement with the toothed or ratcheted inner surface 45 of the tension ring 43 by a spring 72 mounted beneath the stop 71. Preferably there are two stops 71 mounted in holes 37 on opposing sides of the tubular flange 36. Each stop 71 has a beveled end 75 and locking keys 73 formed at an opposing end and preferably on opposing sides of the stop 71, which engages a corresponding keyway 74 in the holes 37 in the flange 36 for insertion therein, orienting the beveled end 75 to drive in one direction and ratchet in the other direction. The outwardly extending beveled engagement face 75 of each stop 71 is beveled such that the stop 71 acts as a pawl to engage the teeth 44 in the tension ring 43 when the spool 32 is rotated to release the cord 16, thus causing the tension ring 43 and spool 32 to co-rotate. The stop 71 acts to release the spool 32 from the tension ring 43 permitting independent ratcheting rotation of the spool 32 when the spool 32 is rotated in the opposite direction for retraction of the cord 6 thereon. Best seen in FIGS. 10*a* and 10*c*, preferably the teeth 44 on the ratcheted inner surface 45 are formed having a first steep side 76 which engages the stop 71 for co-rotation and a second more gently sloping side 77 which permits the stop 71 to slide therealong for release of the spool 32 for independent ratcheting rotation in the opposite direction.

Means for frictionally engaging 80 slideably and resistively engages the outer surface 47 of the tension ring 43, between the stationary bracket 60 and the tension dial 42 so as to permit the user to increase the resistance and thus the tension on the cord 16 as it is pulled from the spool 32. Preferably, the means for frictionally engaging is a tape 80 which acts upon the spool 32 for adjusting the tension applied thereon and affecting the rotation of the spool 32. Preferably the tape 80 is connected at a first end 81 to the stationary bracket 60, such as at anchor 83 and at a second end 82 to means for indexing, such as a toothed slider 84, and engages the tension ring 43 about the outer surface's channel 46. The tape 80 is connected at the second end 82 by a biasing member, preferably a spring 85. Preferably, the tape 80 has at least a first profiled surface 86 to improve engagement with the outer channeled surface 47 of the tension ring 43.

The toothed slider 84 is mounted in a slot 87 formed in a flange 88 at a top 89 of the bracket 60. A gear wheel 90 is supported for engagement with the toothed slider 84 by a shaft 91 extending from the tension dial 42 to the gear wheel 90. As the tension dial 42 is turned by the user, the gear wheel 90 engages the toothed slider 84, causing it to move in the slot 87 and apply tension to the biasing means 85 and the tape 80. The tape 80, in turn, more tightly engages the tension ring 43, applying an increased frictional force or drag thereon and thereby providing greater resistance to the co-rotation of the tension ring 43 and spool 32. Increased resistance to rotation of the spool 32 results in an increased resistance on the cord 16 as it is pulled from the spool 32. In the preferred embodiment, the resistance can be set up to about 20 pounds of pressure.

The tension dial 42 further comprises a protective washer 100 which is positioned between the housing 12 and a knurled adjustment knob 101. The indicia of tension L, M, H, are preferably formed on the protective washer 100 which is stationary against the housing 12. A circlip or snap ring 102 positioned between the protective washer 100 and the knurled knob 101 engages a groove 92 adjacent an upper end 93 of the shaft 91 attached to the gear wheel 90 for connecting the gear wheel 90 to the knurled knob 101. Fastening means, such as a pin screw 103, are used to retain the knurled knob 101 to the shaft 91.

The apparatus 10 as disclosed herein is adaptable for attachment to a plurality of surfaces. As shown in FIGS. 1-3 and 13, the base 18 is formed having two or more locking lugs 19 extending therefrom, preferably on opposing sides of the base 18. A plurality of auxiliary apparatus are provided for mounting of the apparatus 10 to, including but not limited to, a wall mount bracket 120, a door mount bracket 130 and a wrist or ankle strap 140, each having a socket 110 formed thereon with a co-operating keyway 111 for engagement with the locking lugs 19.

Figure 12:
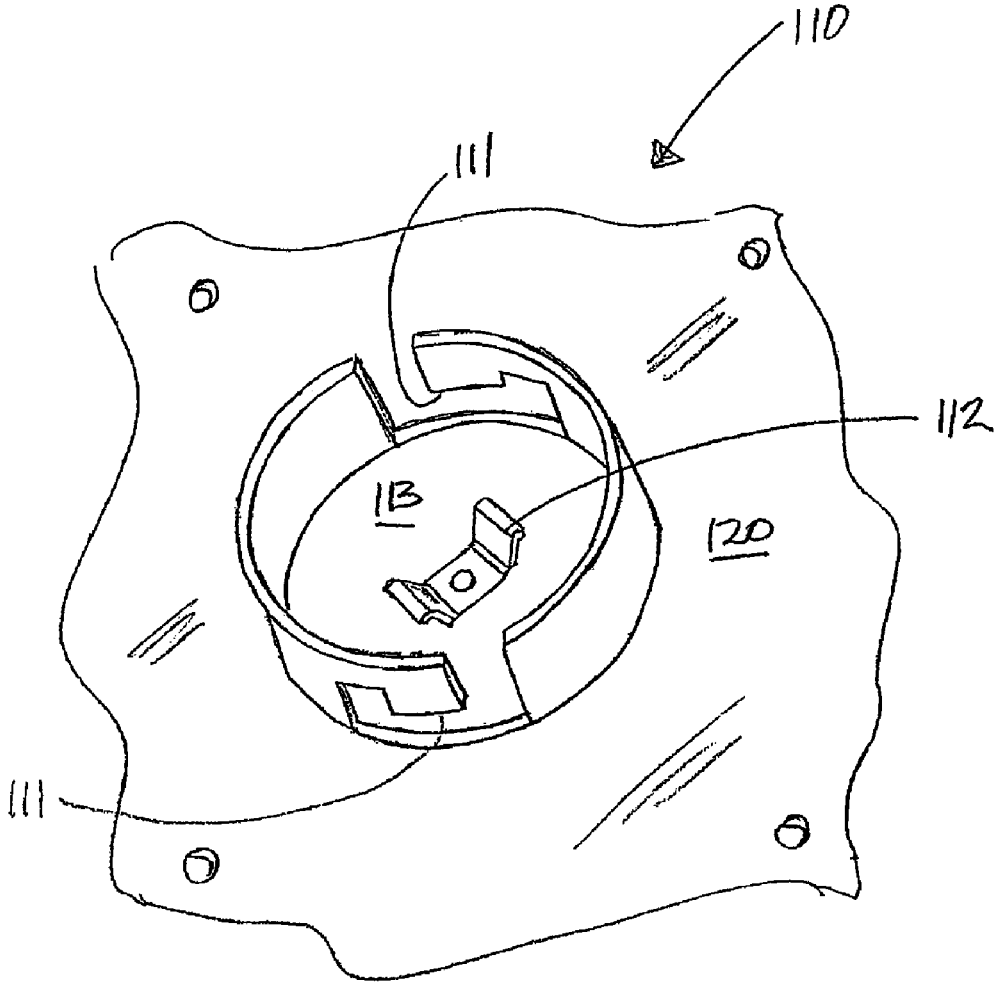
FIG. 12 is a perspective view of a co-operating socket having keyways, the socket being mounted on a surface and having a biasing clip mounted at a center therein.

As shown in FIG. 12, the socket 110 preferably comprises a substantially cylindrical socket 110 being slightly larger in circumference than the base 18 and having two mirror image keyways 111 on opposing sides of the socket 110 for engaging the opposing lugs 19 on the apparatus base 18. The socket 110 further has a clip 112 mounted at a center of a bottom 113 of the socket 110 so as to act as a biasing means to ensure engagement of the base 18 in the socket 110.

Figure 2:
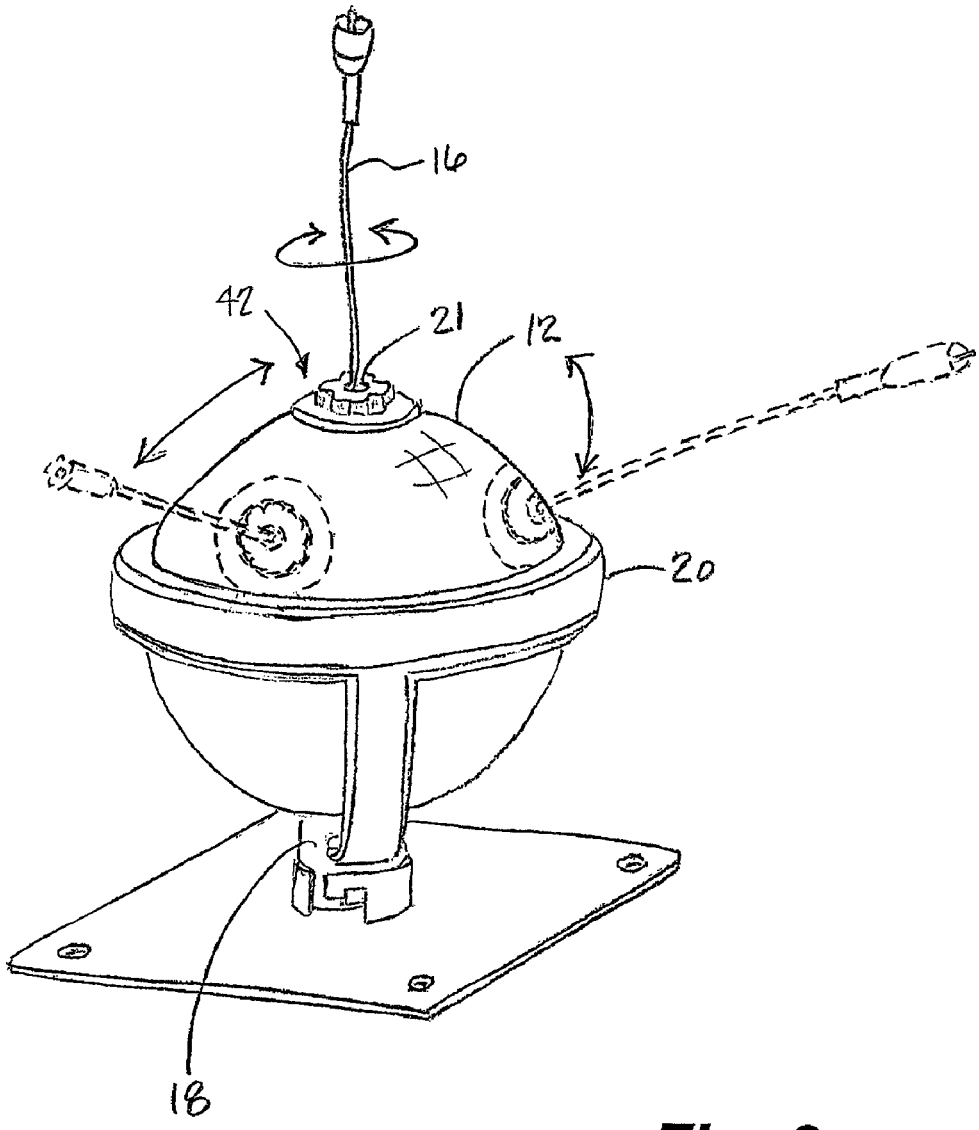
FIG. 2 is a perspective view according to FIG. 1, illustrating rotation of a housing within a support means, a rotated tensile member and tension dial being shown in dotted lines to illustrate rotation about an z-axis and a y-axis.
Figure 3:
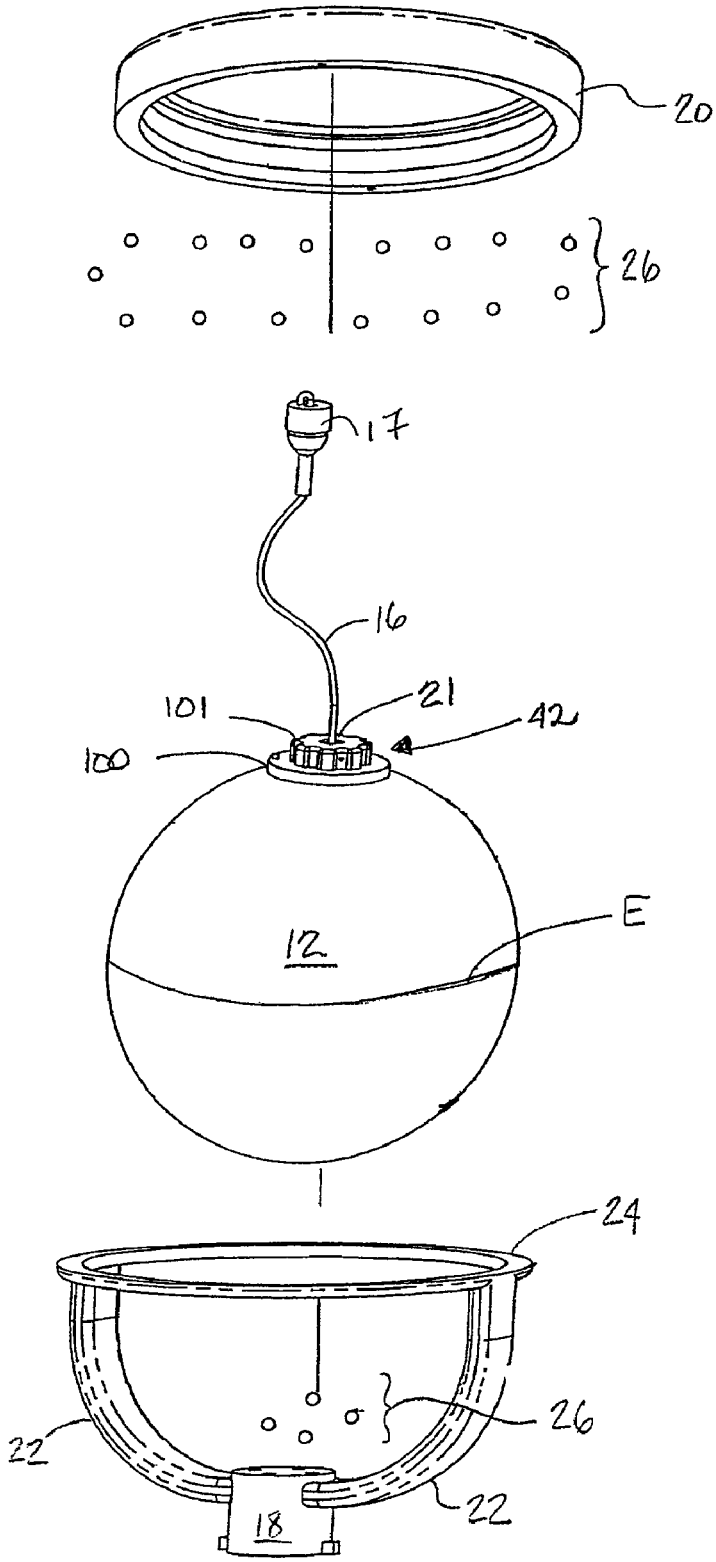
FIG. 3 is an exploded external view according to FIG. 1, illustrating the housing, a support base and a support ring, the base and ring having bearings.
Figure 4:
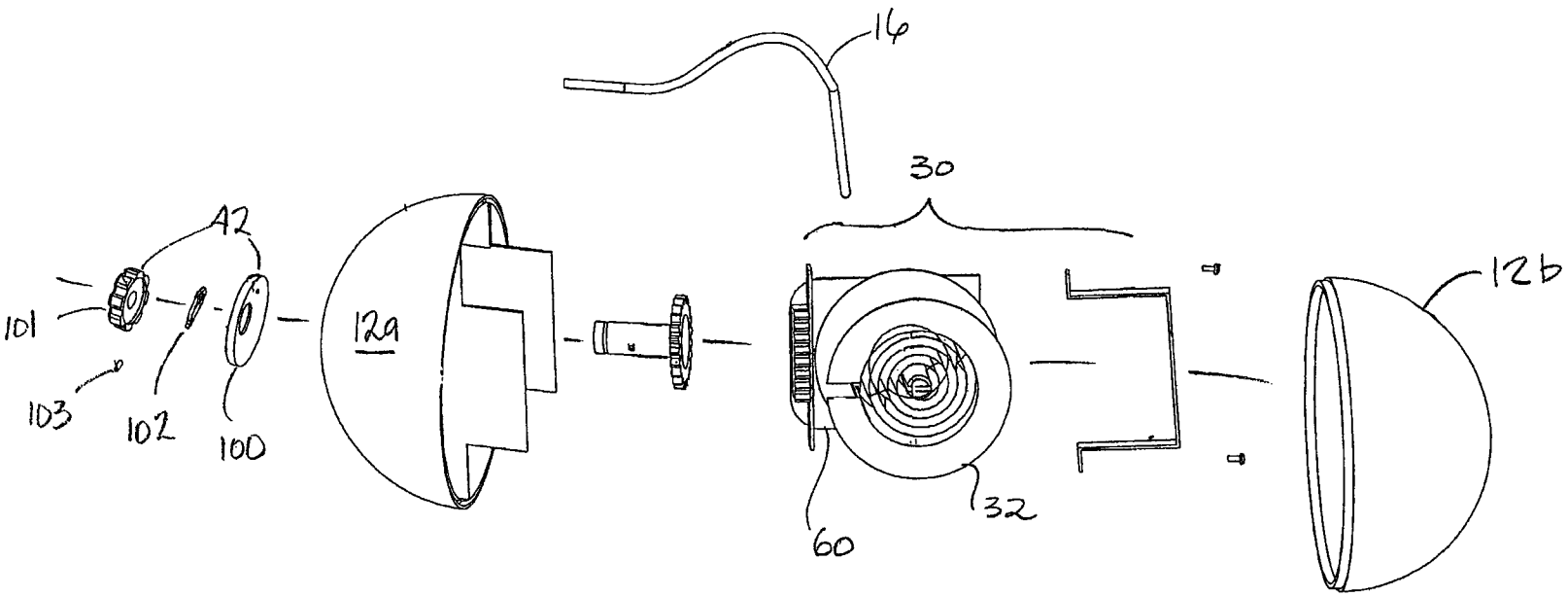
FIG. 4 is an exploded view of the housing of FIG. 2 illustrating the hollow housing having an upper and lower portion and embodiments of a reel assembly and tensioning means mounted in the hollow housing.
Figure 5A:
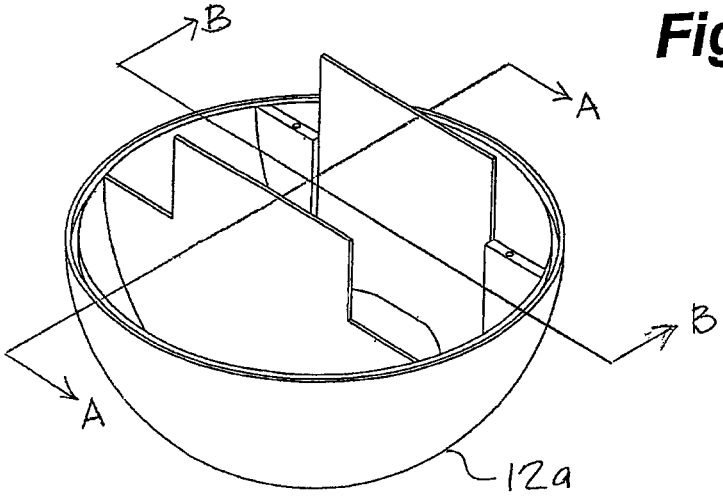
FIG. 5*a* is a perspective view of the upper housing according to FIG. 4.
Figure 5B:
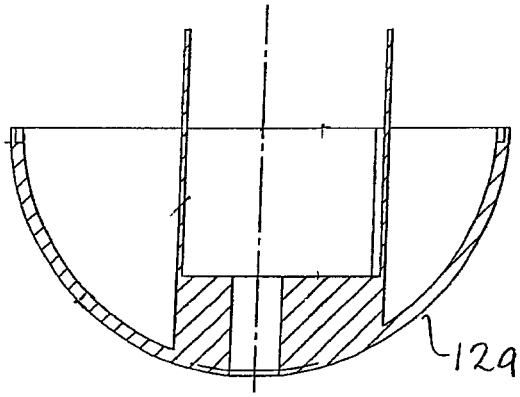
FIG. 5*b* is a sectional view of the upper housing according to FIG. 5*a*, viewed along section lines A-A.
Figure 5C:
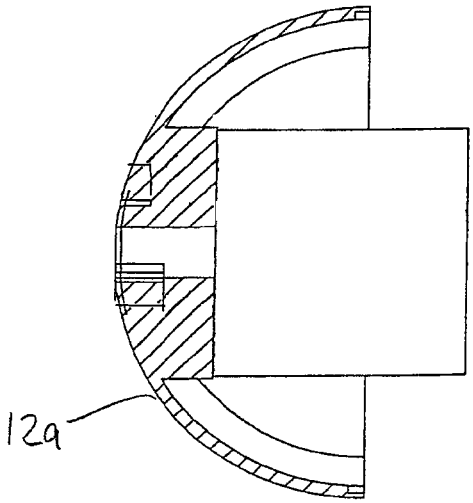
FIG. 5*c* is a sectional view of the upper housing according to FIG. 5*a*, viewed along section lines B-B.

As shown in FIGS. 2 and 12, the socket 110 is formed on a surface, such as plate 120, suitable for mounting directly onto a flat surface such as a wall or a floor using fasteners such as screws.

Figure 13:
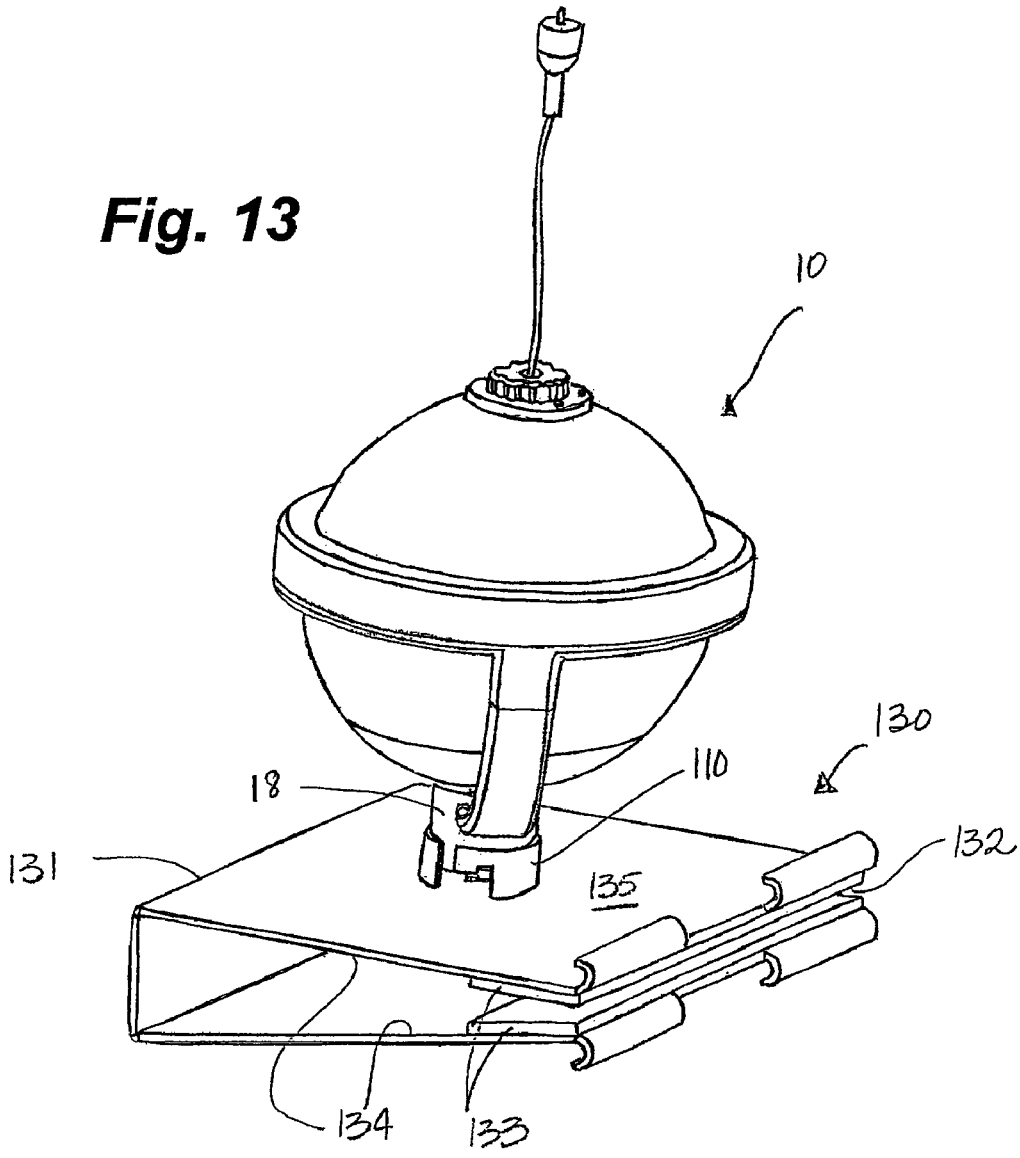
FIG. 13 is a perspective view of the apparatus according to FIG. 1 mounted to a door mounting clip, the base of the apparatus engaging the co-operating socket mounted onto a surface of the door clip.

As shown in FIG. 13, the door bracket 130 comprises a clip body 131 which has a narrowed opening 132 and is manufactured of a suitably resilient material, such as spring metal, so as to allow the opening 132 to be elastically expanded to fit over the edge of a door and thereafter provide sufficient pressure to retain the door bracket 130 thereon. Protective pads 133, such as foam, may be positioned on opposing inner edges 134 of the clip body 131 to prevent damage to the door surface when engaged thereon. The socket 110 is formed on a surface 135 of the clip body 131 for engagement with the apparatus base 18.

Figure 14A:
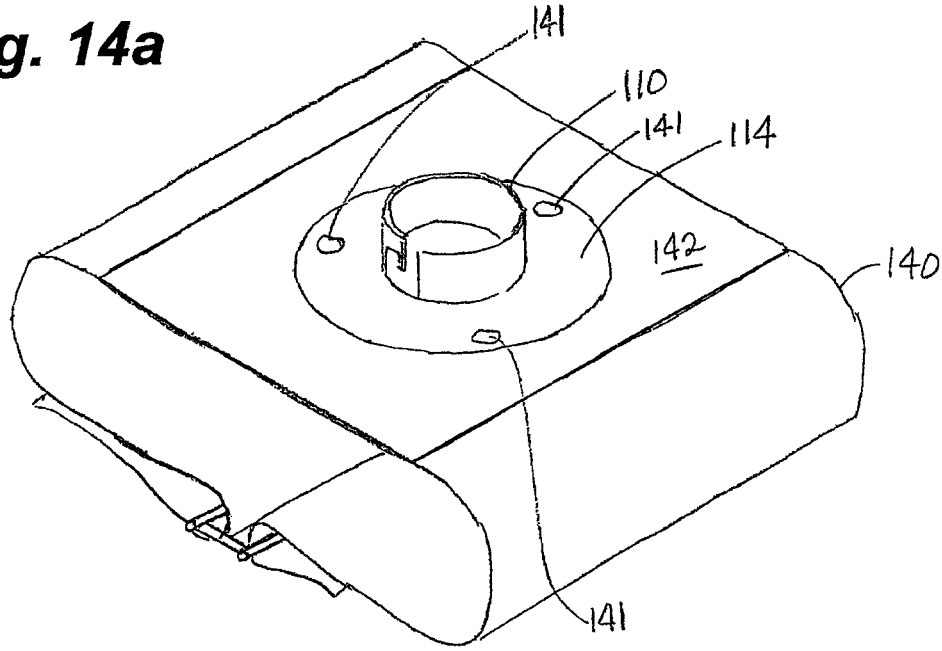
FIG. 14*a* is a perspective view of a strap to which the co-operating socket according to FIG. 12 is mounted, the strap being suitable for attaching the apparatus to a user's body part.

Further as shown in FIG. 14*a*, the plate 114 may be mounted to an adjustable strap 140, such as by rivets 141, the strap 140 being used to attach the apparatus to the user's body. Typically a reinforcement patch 142 may be used to ensure the rivets do not tear out of the strap material during use. Further, a cover (not shown) may be sewn or otherwise attached over the reinforcement patch 142 and the rivets so that the rivets are not visible to the user.

Figure 14B:
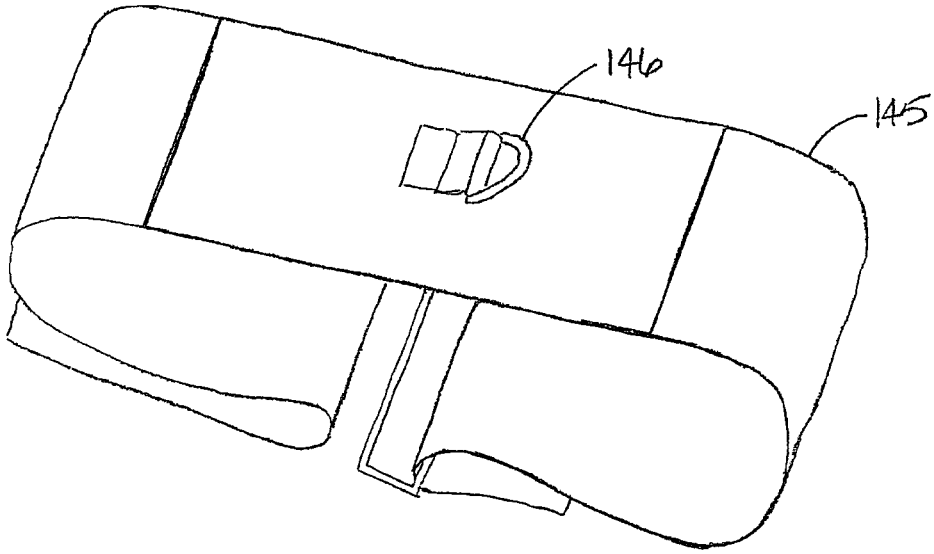
FIG. 14*b* is a perspective view of a strap to which a D-ring is attached for connection of an end of the tensile member thereto, the strap being suitable for attachment to a user's body part.

As shown in FIG. 14*b*, a second strap 145 may be provided having a D-ring 146 affixed thereto, the D-ring 146 being suitable for connection of an end 17 of the cord 16 thereto so as to permit the end 17 of the cord 16 to be attached to a user's body part.

Figure 15:
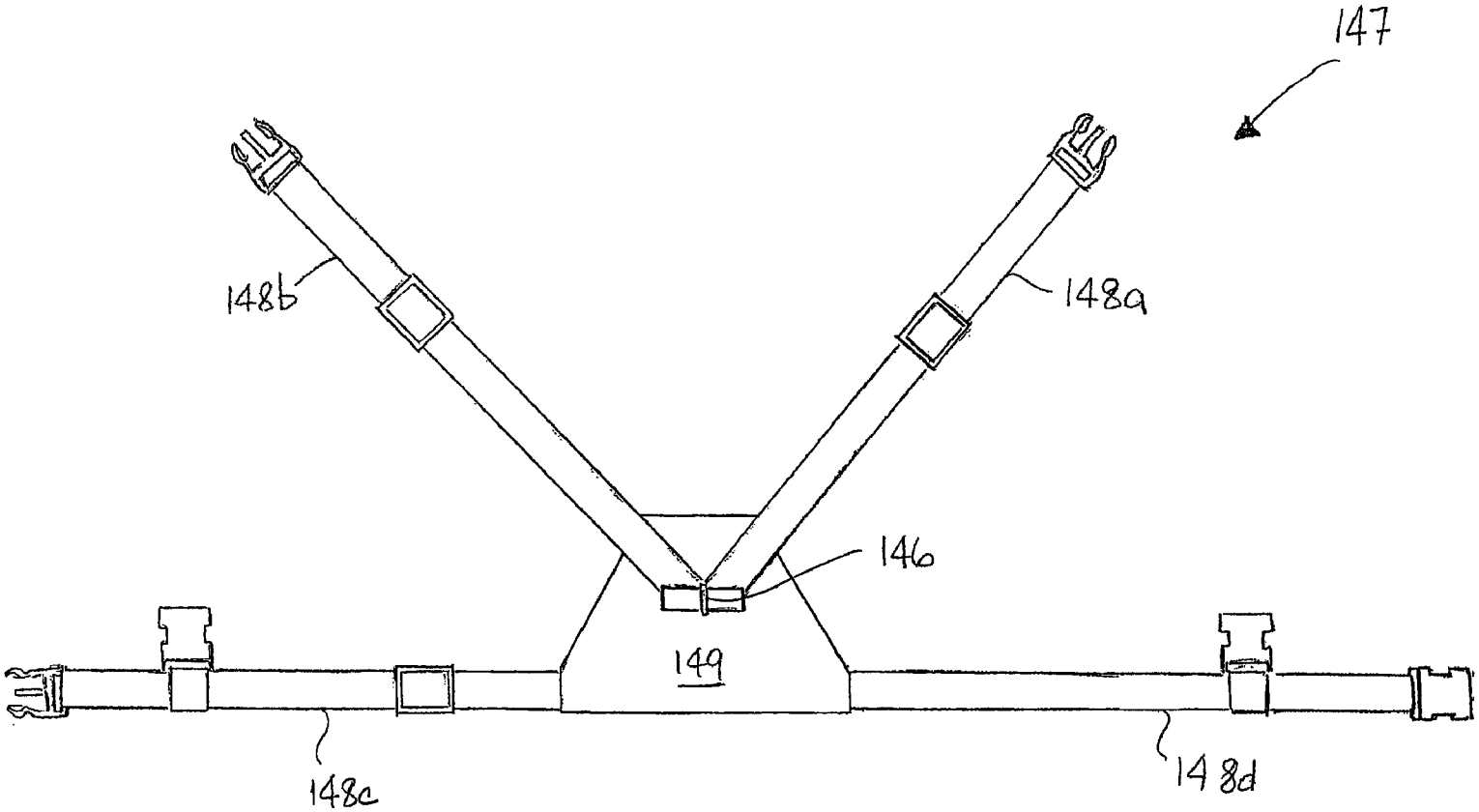
FIG. 15 is a plan view of a chest strap for connection to a user's torso, the strap having a ring positioned thereon for positioning at the user's chest, the ring being used for connection of the cord thereto.

As shown in FIG. 15, a torso strap 147 may be provided for permitting the D-ring 146 to be positioned at a the user's chest such as for performing sit up exercises, the end 17 of the cord being attached thereto. A pair of shoulder straps 148*a*, 148*b* and chest straps 148*c*, 148*d* are connected to chest patch 149 for positioning the D-ring 146 at the chest.

Figure 16:
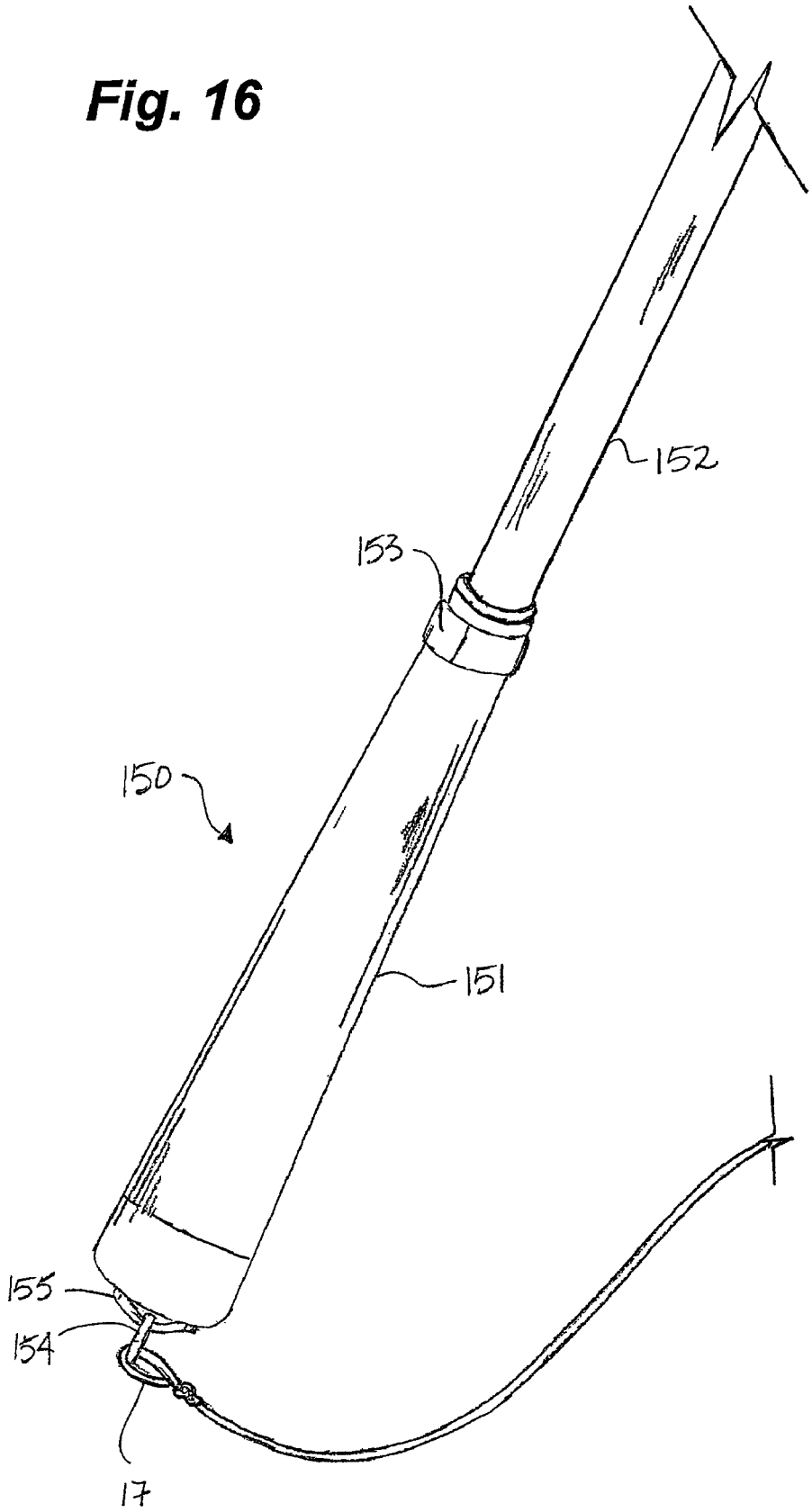
FIG. 16 is a perspective view of a sleeve for connection to a grip end of a sport apparatus such as a golf club, an end of the tensile member being connected to a butt end of the sleeve.

Having reference to FIG. 16 and in a further embodiment, a sleeve 150 is provided for connection of the end 17 of the cord 16 to a grip end 151 of a sport apparatus such as a golf club 152. One of skill in the art would understand that the sleeve 150 may be used, with or without modification, for connection of the apparatus 10 to a variety of different types of racquets and handheld sports apparatus. Preferably, the sleeve 150 is positioned to overlie the grip 151 of the club 152 and is fastened thereon by a hook and loop strap 153. A D-ring 154 is affixed, such as by sewing a tab 155 connected through the D-ring 154, to an end 156 of the sleeve 150 which covers the butt of the club's grip 151. In use, the exercise apparatus 10 is mounted to the ankle strap 140 which is attached to a golfer's leading ankle and the golf club 152 is connected to the end 17 of the cord 16 using the sleeve 150. As the golfer swings, the cord 16 provides resistance which aids in building muscle and training the golf swing to protect the golfer from injury and to perfect the swing.

In Use

In use, the apparatus 10 may be mounted to a stationary surface, such as a door or the wall or the apparatus can be mounted to a body part such as to the user's ankle, wrist, thigh, chest or the like. Generally, the cord 16 is pulled against the resistance and along a particular path in order to use specific muscles or muscle groups. Literally hundreds of exercises can be performed, using the apparatus to provide resistance.

Tension resistance of the cord 16 can be adjusted and the housing 12 of the apparatus 10 rotates to adapt to different angles of the cord 16 to the base 18, Great flexibility in mounting is enabled as the housing 12 is free to rotate to the direction of the exercise.

EXAMPLE 1

Figure 17A:
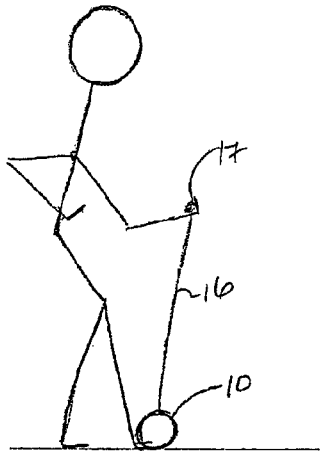
Figure 17B:
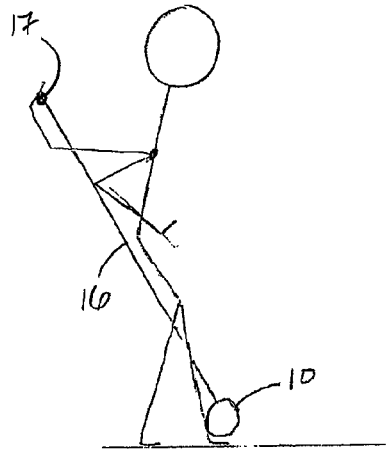
FIG. 17*b* illustrates an end of the backhand stroke.

As shown in FIGS. 17*a*-17*b*, the apparatus 10 can be used for training strokes for use in racquet sports.

In FIGS. 17*a* and 17*b*, the apparatus 10 is attached to an ankle using a strap and the user holds the end 17 of the cord 16 (FIG. 17*a*) and moves the arm along the path of a backhand stroke (FIG. 17*b*). As the arm sweeps rearwardly, the housing 12 of the apparatus 10 rotates to align the housing 12 and cord 16. Alternately, the cord 16 is connected to the racquet using the sleeve 150 and the user holds the racquet while performing the stroke.

Figure 17C:
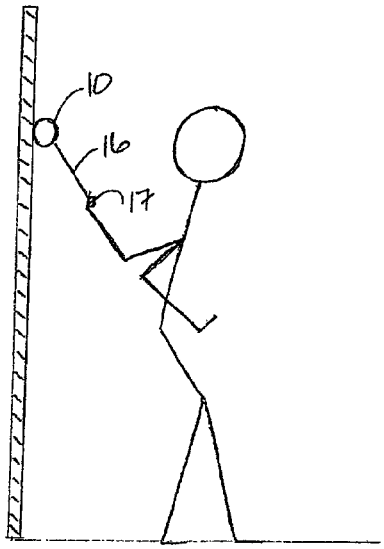
FIGS. 17*c* and 17*d* are schematic elevation views of a user performing a forehand stroke for racquet sports, more particularly.
Figure 17D:
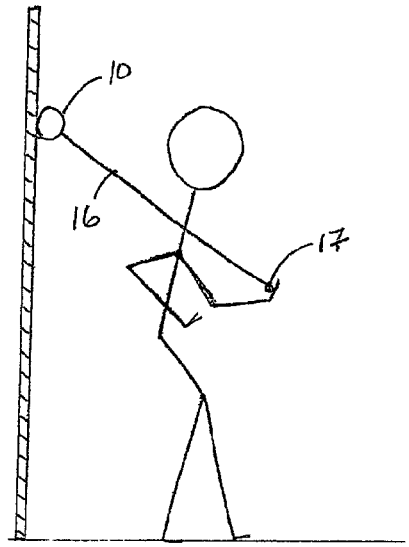

In FIGS. 17*c* and 17*d*, the apparatus 10 is either attached to the wall using a wall mount plate, or to a door using a door bracket, both above shoulder height or to the trailing ankle using a strap. The user holds the end 17 of the cord 16 or the racquet to which the cord has been connected such as through the sleeve 150 (FIG. 17*c*) and moves the arm along the path of a forehand stroke (FIG. 17*d*). Throughout the path, the housing 12 of the apparatus 10 rotates to align the housing 12 with the cord 16.

EXAMPLE 2

As shown in FIGS. 18*a*-18*f*, the apparatus 10 can be used to strengthen a variety of leg muscles. In each example shown, the apparatus is strapped to one ankle and the end 17 of the cord 16 is attached, such as by tying or connecting the end to a D-ring attached to the second strap, to the other ankle. In each case, the housing 12 of the apparatus 10 rotates to align with the cord 16.

Figure 18A:
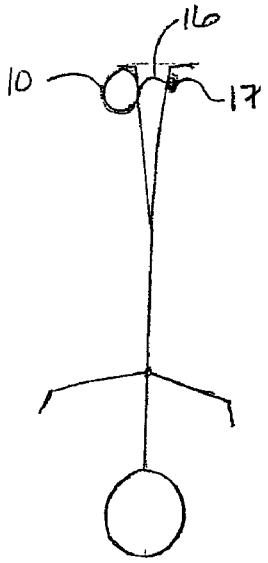
FIGS. 18*a* and 18*b* are schematic plan views of a user in a supine position and performing supine hip abductor kicks; more particularly
Figure 18B:
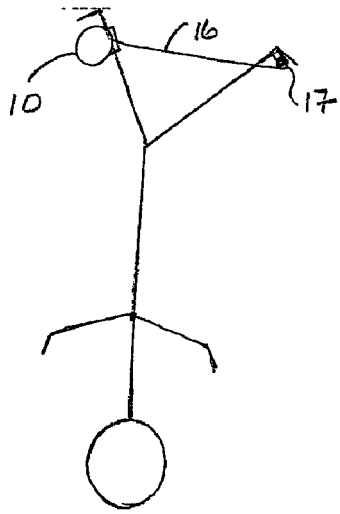

In FIGS. 18*a* and 18*b*, supine hip abductor kicks are illustrated wherein the user lies supine and the hip is abducted with multi-planar leg movement.

Figure 18C:
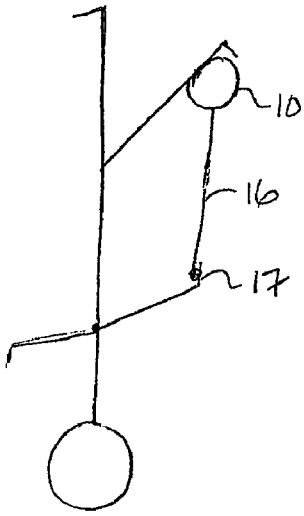
FIGS. 18*c* and 18*d* are schematic plan views of a user in a supine position and performing supine hip adductor kicks; more particularly
Figure 18D:
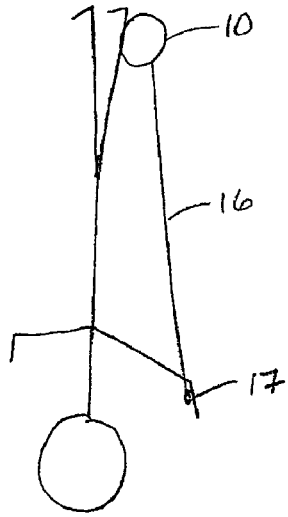

In FIGS. 18*c* and 18*d*, supine hip adductor kicks are illustrated wherein the user lies supine and the hip is adducted at the same time as the arm is abducted.

Figure 18E:
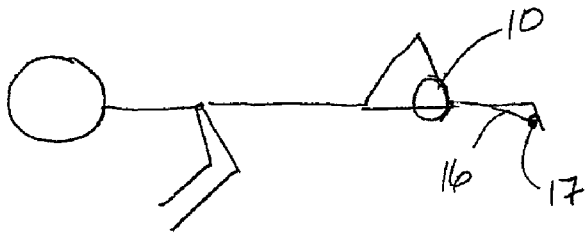
FIGS. 18*e* and 18*f* are schematic side views of a user in a side lying position and performing side lying hip adductor lifts; more particularly
Figure 18F:
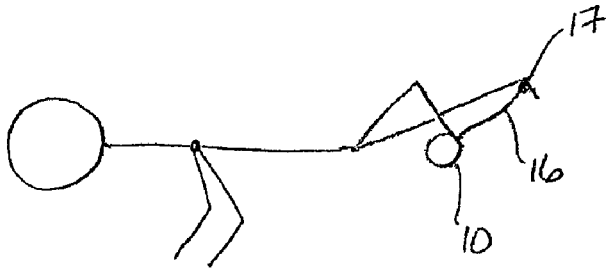

In FIGS. 18*e* and 18*f*, side lying adductor lifts are illustrated wherein the user lies on their side with an upper knee bent and a lower leg straight, the lower leg being repeatedly adducted.

EXAMPLE 3

As shown in FIGS. 19*a*-19*d* and 20*a*-20*b*, a number of arm and chest muscles can be exercised wherein the apparatus is secured to a wall or a door.

Figure 19A:
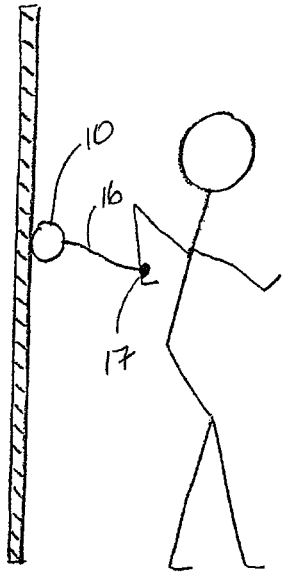
FIGS. 19*a* and 19*b* are schematic elevation views of a user performing a horizontal arm extension, more particularly.
Figure 19B:
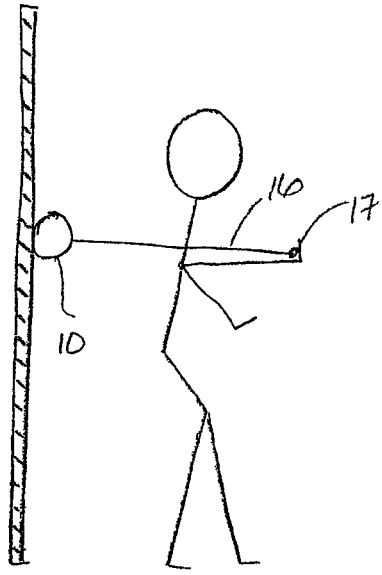

In FIGS. 19*a* and 19*b*, the apparatus 10 is mounted to the wall or door at shoulder height. The end 17 of the cord 16 is held in the hand or is attached to a handle (not shown) which is held in the hand and the shoulder blade is first retracted and then protracted for horizontal arm extension.

Figure 19C:
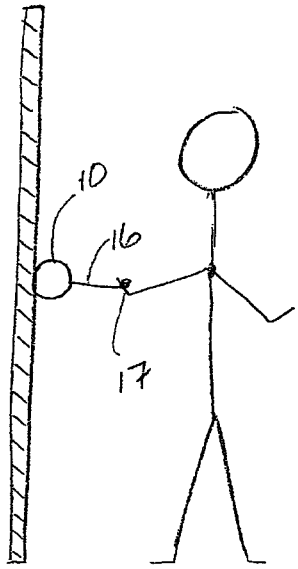
FIGS. 19*c* and 19*d* are schematic elevation views of a user performing pectoralis muscle stretching and strengthening, more particularly.
Figure 19D:
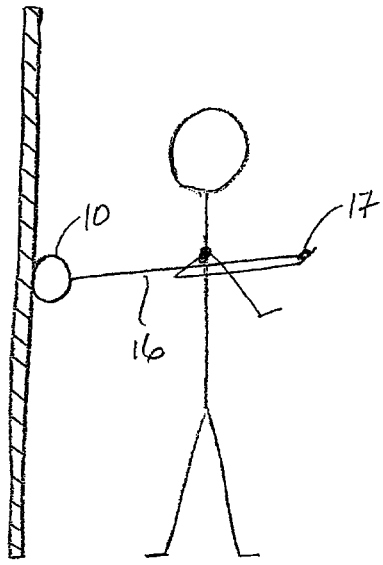

In FIGS. 19*c* and 19*d*, the apparatus 10 is mounted to the wall or door at shoulder height. The pectoralis muscles are stretched and strengthened by first standing with the arm horizontal and the cord relaxed and then pulling the cord 16 by adducting the arm across the chest to contract the pectoralis muscles.

Figure 20A:
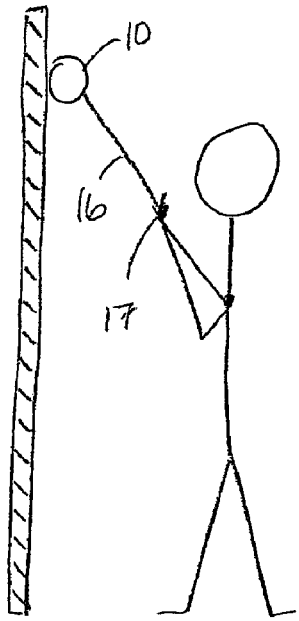
FIGS. 20*a* and 20*b* are schematic elevation views of a user practicing a downswing movement for training a golf stroke, more particularly
Figure 20B:
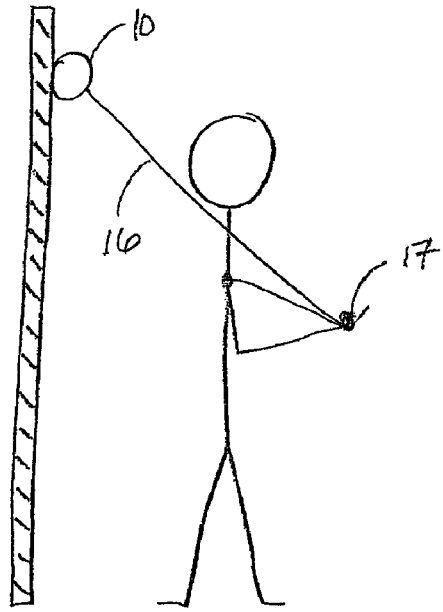

In FIGS. 20*a* and 20*b*, muscles used in the golf swing are strengthened by mounting the apparatus 10 to a wall or door above the users head so that at a top of the golf swing, without using a club, the cord 16 held in the user's hands, such as by a handle, is relaxed. As the user moves the hands along the path of the normal hand motion of the golf swing, the cord 16 is pulled from the apparatus 10 against resistance.

The embodiments of the invention in which an exclusive property or privilege is claimed are defined as follows:

1. An apparatus for performing exercises with resistance comprising:
- a tensile member;
- a reel assembly for repeatedly deploying and retracting the tensile member thereon;
- a substantially spherical housing for rotatably supporting the reel assembly therein; and
- a support for rotatably supporting the housing therein, the support having:
  - a ring encircling the housing between an equator of the housing and the tensile member so as to retain the housing in the support, the ring supporting the housing for rotation therein;
  - a base spaced from the ring on an opposing side of the equator from the tensile member for rotationally supporting the housing between the ring and the base; and
  - two or more arcuate span members from connecting between the base and the ring;
- wherein the support has a z-axis extending therethrough, the substantially spherical housing being supported therein for rotation substantially 360 degrees about the z-axis, the housing being further rotational about an x-axis and a y-axis, rotation being limited about the x and y-axes by interference contact of at least the tensile member with the ring.

2. The apparatus of claim 1 wherein the base further comprises bearings supported in the base between the housing and the base for rotation of the housing thereon.

3. The apparatus of claim 1 wherein the ring further comprises bearings supported therein between the housing and the ring for rotation of the housing thereon.

4. The apparatus of claim 1 wherein the housing is rotatable about 120 degrees about the y-axis.

5. The apparatus of claim 1 wherein the housing is hollow, the reel assembly further comprising:
- a spool for releasably retaining the tensile member thereon;
- means for tensioning the spool for adjusting a tension applied thereon, altering resistance to unwinding the tensile member from the spool; and
- means for mounting the reel assembly in the housing.

6. The apparatus of claim 5 further comprising:
- a tension dial mounted on an exterior of the housing and connected to the means for tensioning in the housing for remotely adjusting the tension applied to the spool.

7. The apparatus of claim 5 wherein the means for mounting the reel assembly in the hollow housing is a bracket.

8. The apparatus of claim 5 wherein the means for tensioning comprises:
- a tape adjustably acting on the spool;
- means for indexing connected to a band using means for biasing; and
- a gear connected between a tension dial and the means for indexing, wherein when the tension dial is rotated the gear engages the means for indexing for adjusting the tension of the band acting on the spool for increasing or decreasing friction between the band and a portion of the spool so as to increase or decrease the tension applied thereto.

9. The apparatus of claim 8 wherein the means for tensioning further comprises:
- a tubular flange extending outwardly from the spool;
- a tension ring having a toothed inner surface for engaging the tubular flange and a channeled outer surface for engaging the tape; and
- a clutch releasably connected between the toothed inner surface of the tension ring and the tubular flange for permitting co-rotation of the spool and the tension ring when the spool is rotated to release the tensile member and to release the spool for independent rotation when the spool is rotated in an opposite direction for retraction of the tensile member thereon.

10. The apparatus of claim 9 wherein the clutch comprises:
- two or more stops moveably mounted in the tubular flange, each stop having an angled engagement face for engaging the toothed inner surface when the spool is rotated to release the tensile member and for releasing the spool therefrom when the spool is rotated in the opposite direction; and
- two or more springs, each spring mounted beneath a stop for biasing each stop outwardly from the tubular flange for engagement with the toothed inner surface of the tension ring.

11. The apparatus of claim 8 wherein the means for indexing is a toothed slider mounted in a slot on a stationary bracket, the toothed slider being connected to the tape by a spring.

12. The apparatus of claim 8 wherein the gear is mounted on a shaft, the shaft being connected to the tension dial so as to cause the gear to rotate in engagement with the means for indexing when the tension dial is rotated.

13. The apparatus of claim 1 further comprising a retraction assembly, the retraction assembly comprising:
- means for biasing connected to a spool; and
- means for connecting the means for biasing to the housing;
- wherein when force is applied to the tensile member and the spool is rotated to release the tensile member therefrom, the means for biasing is caused to store energy; and
- when the force is released from the tensile member, the means for biasing releases the stored energy causing the spool to move in an opposite direction for retracting the tensile member onto the spool.

14. The apparatus of claim 13 wherein the means for biasing is a spring, wherein the means for connecting is a non-rotating support connecting a first end of the spring to a stationary bracket, and wherein a second end of the spring is connected to the spool, the spring storing energy when wound tightly thereon as the spool is rotated to release the tensile member and releasing energy to return to an original shape causing the spool to rotate in the opposite direction for retracting the tensile member.

15. The apparatus of claim 14 wherein the co-operating socket is adapted to be mounted on a door bracket.

16. The apparatus of claim 14 wherein the co-operating socket is adapted to be mounted on a mounting plate.

17. The apparatus of claim 14 wherein the co-operating socket is adapted to be mounted on a strap.

18. The apparatus of claim 1 wherein an end of the tensile member is adapted for connection to a sleeve for engagement with a grip end of a handheld sport apparatus.

19. The apparatus of claim 1 further comprising a mounting apparatus for mounting the apparatus to a plurality of surfaces.

20. The apparatus of claim 19 wherein in the mounting apparatus further comprises two or more opposing locking lugs extending radially outward from the base and adapted for engaging opposing keyways in a co-operating socket, the co-operating socket being mountable to a plurality of surfaces for engagement of the apparatus therewith.

* * * * *